US005176405A

United States Patent [19]

Kaule et al.

[11] Patent Number: 5,176,405

[45] Date of Patent: Jan. 5, 1993

[54] SECURITY DOCUMENT HAVING A SECURITY ELEMENT EMBEDDED THEREIN WITH VISUALLY AND MACHINE-TESTABLE MARKS

[75] Inventors: Wittich Kaule, Emmering; Michael Bohm, Heimstetten, both of Fed. Rep. of Germany

[73] Assignee: GAO, Gesellschaft fur Automation und Organisation MBH, Fed. Rep. of Germany

[21] Appl. No.: 659,335

[22] PCT Filed: May 11, 1990

[86] PCT No.: PCT/EP90/00765

§ 371 Date: Mar. 7, 1991

§ 102(e) Date: Mar. 7, 1991

[87] PCT Pub. No.: WO90/13878

PCT Pub. Date: Nov. 15, 1990

[30] Foreign Application Priority Data

May 12, 1989 [DE] Fed. Rep. of Germany ..... 3915638

[51] Int. Cl.[5] ..... B42D 15/00

[52] U.S. Cl. ..... 283/83; 283/72; 283/91; 283/901; 162/106

[58] Field of Search ..... 283/83, 901, 72, 904, 283/91; 162/106

[56] References Cited

U.S. PATENT DOCUMENTS

| | | | |
|---|---|---|---|
| 4,504,084 | 3/1985 | Jarroh | 285/901 X |
| 4,652,015 | 3/1987 | Crane | 283/901 X |
| 4,927,180 | 5/1990 | Trundle et al. | 283/901 X |
| 4,943,093 | 7/1990 | Melling et al. | 283/901 X |

FOREIGN PATENT DOCUMENTS

| | | |
|---|---|---|
| 1446851 | 11/1968 | Fed. Rep. of Germany . |
| 1774290 | 1/1972 | Fed. Rep. of Germany . |
| 2152090 | 6/1972 | Fed. Rep. of Germany . |
| 3906695 | 9/1989 | Fed. Rep. of Germany . |
| 3843077 | 6/1990 | Fed. Rep. of Germany . |
| 500151 | 2/1939 | United Kingdom . |
| 1365876 | 9/1974 | United Kingdom . |

*Primary Examiner*—Timothy V. Eley
*Assistant Examiner*—William Fridie
*Attorney, Agent, or Firm*—Bacon & Thomas

[57] ABSTRACT

In a security document having an embedded security element in the form of a transparent thread with electrically conductive material in at least two layers, at least one layer is transparent or partly transparent at least in certain areas. The partly transparent layer interacts with marks located on the thread in such a way that the marks are largely concealed in incident light but are recognizable visually in transmitted light.

27 Claims, 1 Drawing Sheet

Figure 1:
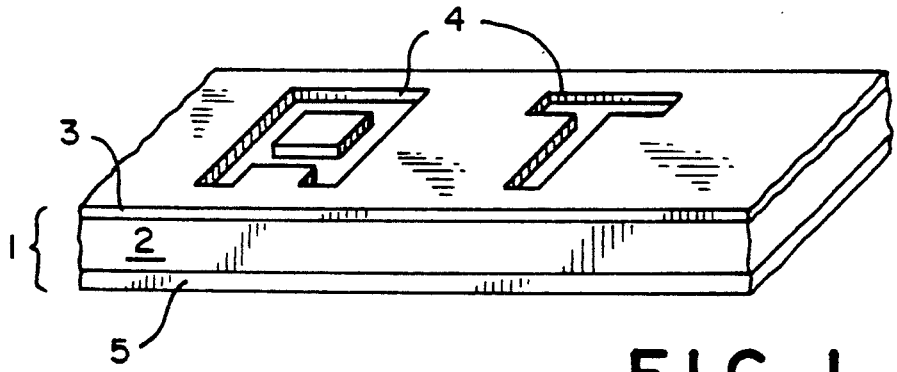

SECURITY DOCUMENT HAVING A SECURITY ELEMENT EMBEDDED THEREIN WITH VISUALLY AND MACHINE-TESTABLE MARKS

The present invention relates to a security document having a security element in the form of a transparent thread or strip embedded therein bearing visually recognizable marks in the form of characters, printed patterns and the like and designed so as to be electrically conductive for machine-testability.

It is known to protect security documents by embedding therein security elements that exhibit particular machine-detectable physical properties and/or have a visual appearance that permits them to serve as authenticity features for the security document. These security elements are e.g. threads or strips that are embedded directly in the paper layer as it is forming in the course of the paper production.

For example, German laid-open print no. 14 46 851 discloses a safeguarding thread provided on both sides with microprints. To allow for the patterns printed on the front and the back to be checked independently of each other an aluminum layer is placed therebetween. This aluminum layer can also serve as a machine-readable feature if its electric conductivity is determined. In practice this form has not proved to be very useful since the aluminum layer makes the safeguarding thread opaque and the writing can only be recognized in incident light and even then only with great difficulty. It is usually necessary to make the paper transparent by chemical means at least for the time of testing. Furthermore, the microprint of the safeguarding thread overlaps the outer printed pattern, which is likewise felt to be disturbing in many cases.

Since safeguarding threads can only be embedded up to a certain width without holes during sheet forming, it has been proposed to incorporate porous threads, which can be of accordingly wider design (German laid-open print no. 21 52 090). In a special embodiment a safeguarding thread is also described that shows different colors when viewed in incident light and in transmitted light. The thread is provided for this purpose with two color layers having a semitransparent aluminum coating therebetween. When this thread is viewed in incident light after it is embedded in the paper, the color layer located above the reflective aluminum coating is dominant, while in transmitted light the secondary color from the two colors will be the dominant color. However, such threads involve adhesion problems between the color layers and the metal layer located therebetween, whereby the outer color layer can even be detached from the metal layer. Although this thread is thus basically machine-testable with respect to its electric conductivity, this feature is not a reliable authenticity feature due to the lack of durability of the metal coating over the total length of the thread. Cracks or partial detachment of the metal layer will already cause an interruption in the electric conductivity. Such security documents are accordingly classified as forgeries in during machine testing although they are authentic.

A safeguarding thread having very easily tested writing after being embedded in paper is known e.g. from U.S. Pat. No. 4,652,015. This thread comprises a transparent carrier having printing in the form of a plurality of single shiny microcharacters. The known safeguarding thread and the microcharacters located thereon are not recognizable in incident light. In transmitted light, on the other hand, solely the characters are visible as sharply contoured marks since the carrier itself is designed so as to be transparent. Such a safeguarding thread is produced by metalizing a transparent film with an aluminum layer over a large surface, printing the microcharacters on this layer using an acidproof ink, and then etching off the unprinted areas, leaving the characters as single characters separated from one other on a transparent background.

This thread accordingly has an easily recognized visual feature, but loses the property of electric conductivity due to the split into single characters and the resulting interruption in the metal layer. It is thus unsuitable for machine testing.

Non-prepublished German patent no. 38 07 126 describes a safeguarding thread having a metal coating with characters worked into it in a negative form. When the security document is viewed in transmitted light the characters are visible as light marks on a dark background. This form of presentation makes it possible to produce the safeguarding thread with an uninterrupted metal coating so that the electric conductivity is in principle maintained over the entire length of the thread. The recesses in the metal layer necessary for representing the characters, however, increase the probability of this metal layer being cracked by frequent bending and use of the security document, which no longer permits the electric conductivity to be tested.

The invention is based on the problem of providing a security element in the form of a thread or strip suitable for embedding in a security document and bearing an easily recognized visual mark in the form of writing or a printed pattern, etc., the safeguarding thread additionally having electrically conductive properties as a machine-readable feature and this property being reliably and clearly detectable even after strong mechanical stressing of the security document.

This problem is solved by the features stated in the characterizing part of the main claim.

In known safeguarding threads containing only one electrically conductive layer, cracks in the metal coating generally lead to an interruption in the conductivity so that it is no longer testable. In the preferred embodiment of the inventive solution there are now two conductive layers that are capacitively coupled by a nonconductive layer (plastics film, adhesive layer, etc.) forming a dielectric. The conductivity of such threads is tested according to the invention not by galvanically contacting the electrically conductive layers, but by capacitively coupling in high-frequency signals. If cracks occur in the metal layers, the metal layers interrupted by these cracks, with the dielectric therebetween, act as series or parallel connected capacitors depending on the test setup. This maintains an a.c. conductivity that permits interrupted layers to be tested. In particular when the two metal layers are not fully interrupted at the same place in the thread. If this a.c. conductivity is measured by known capacitive methods of measurement, as described for example in German laid-open print no. 38 43 077 or German patent no. 17 74 290, the presence of two electrically conductive layers can be deduced even if there are one or more ruptures in one or both metal coatings, so that this feature indicating authenticity can still be clearly detected.

One of these electrically conductive layers may be an opaque metal coating that, according to the application described in DE-P 38 07 126, contains recesses in the form of characters. The second electrically conductive layer is preferably a transparent, electrically conductive ITO layer (indium tin oxide) applied, for example by the sputtering technique, to the same side of the synthetic thread or to the opposite side. Since the second electrically conductive layer is transparent, the printing in the first opaque metal layer is unchanged in its good visibility.

Instead of sputtering on transparent layers, which is more expensive in terms of materials processing, one can also evaporate on appropriately thin aluminum layers, which when applied e.g. in an amount of approx. 20 mg/m$^2$ exhibit sufficient surface conductivity and are sufficiently transparent for the negative writing to be readily visible at least in transmitted light.

But also other safeguarding threads, e.g. printed safeguarding threads, can be made electrically conductive by this method without substantially impairing the visual testability of the printed pattern. In a preferred embodiment, the safeguarding thread comprises a transparent carrier film provided on one or both sides with a printed pattern or writing, an opaque ink being used for producing this print. This print is provided on both sides with a partly transparent metal coating which gives the thread its electric conductivity. Furthermore, the partly transparent metal coating, due to its reflection properties, causes the print on the safeguarding thread not to appear, or hardly to appear, when the security document is viewed in incident light. There is therefore no possibly disturbing overlapping between the outer print on the security document and the print on the safeguarding thread embedded in the security document.

A further embodiment of the partly transparent layer comprises the use of a conductive plastics material. Such plastics materials are generally not supertransparent, like photoconductive materials, but partly transparent so that they can be combined inventively with other properties detectable in transparency.

In a further development of the invention, properties of a safeguarding thread that are visually recognizable in transmitted light are also testable by machine. During an attempt at machine detection, visually very striking properties of a thread, such as its color or its microprint, are lost in the colored getups of the safeguarding thread customarily contained in the security document. However, if the safeguarding thread is equipped according to the invention with partly transparent conductive material this can be used to "trigger" the measurement of the other properties. That is, the measurement, e.g. of color or of structured prints, takes place precisely at the place where the conductivity occurs. In this way, coincidence measurement of conductivity and other properties of the safeguarding thread recognizable in transmitted light make it possible to associate them reliably.

A further embodiment of the invention relates to the machine detection of transparency properties of the safeguarding thread which are not detectable visually, e.g. the infrared absorption. The infrared absorption of the thread is lost, as described above, in the diverse infrared absorption properties of the security document if the measurement cannot be precisely associated with the location of the safeguarding thread. According to the invention the conductivity of the safeguarding thread helps to reliably trigger the measurement of the other properties here, too.

With known safeguarding threads characterized by a printed pattern visible in transmitted light, the easily machine-testable feature of electric conductivity had to be wholly dispensed with up to now in the case of positive writing, while this property was at least highly prone to failure in the case of negative writing due to the mechanical loads, thereby reducing its value for automatic authenticity testing.

Since even interrupted metal layers exhibit a.c. conductivity, at least one or more of the conductive layers can also be designed as screens, such as line, hole or cross screens, with possibly opaque screen elements. The degree of transparency of these conductive layers can be varied when using opaque screen elements by the structural size of these elements (line width, etc.) and the surface area covered (screen intervals, etc.).

The present invention makes it possible to provide safeguarding threads with any desired characters, printed patterns, etc., without impairing the electric conductivity. The conductivity as such is still measurable after relatively high loads or even if there are interruptions, which increases their fail-safety and their value for automated testing systems. This safeguarding thread is not only machine testable but also has an appearance varying in incident light and in transmitted light that cannot be imitated by alternative measures. The change in appearance is thus utilizable as a visual feature that also allows for authenticity testing without the use of any aids. If a paper of value equipped with the inventive safeguarding thread is reproduced using commercial copying apparatus, in particular color copiers, neither the machine-testable properties nor the readily visible properties are reproducible. The stated safeguarding thread thus also provides effective copying protection for papers of value.

Figure 2:
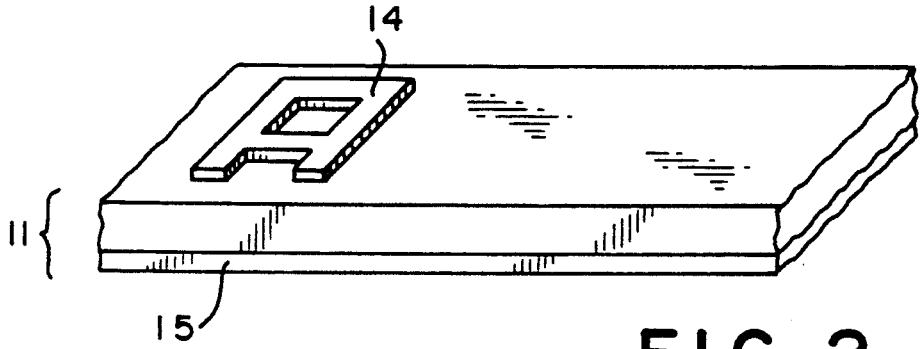
Figure 3:
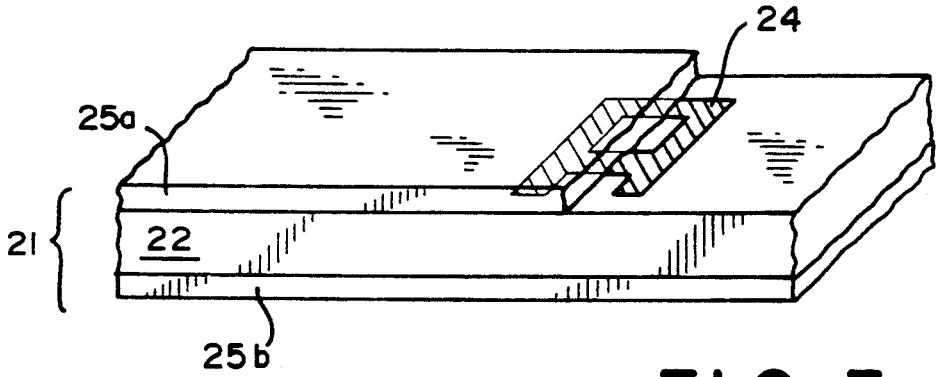
Figure 4:
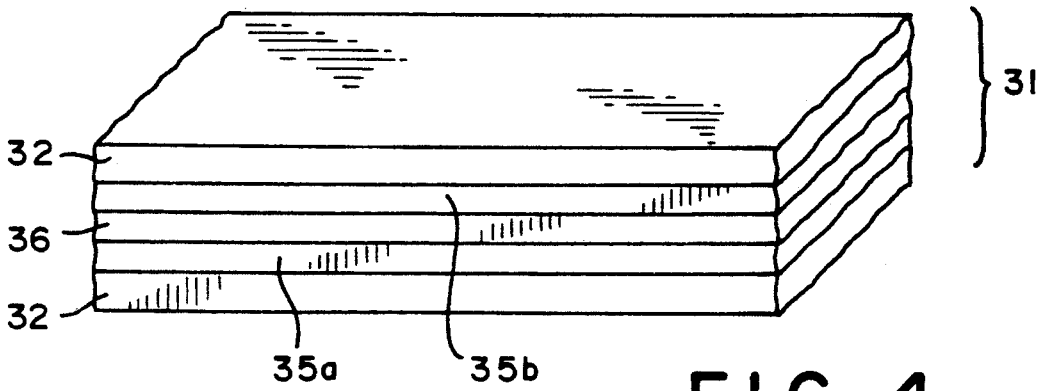

Further advantages and advantageous developments will emerge from the description of exemplary embodiments of the invention with reference to the figures, in which FIG. 1 shows a safeguarding thread with negative writing in a metal layer, FIG. 2 shows a safeguarding thread with positive metal writing and additional electrically conductive coatings, FIG. 3 shows a safeguarding thread with a printed pattern and electrically conductive layers, FIG. 4 shows a safeguarding thread constructed of two films.

FIG. 1 shows a safeguarding thread 1 usable in antifalsification papers that comprises a plastics strip 2 made of a tear-resistant plastics material such as polyester, and having on one surface an opaque coating 3. This coating is preferably a reflective metal layer, e.g. an aluminum layer, that has recesses 4 in the form of the characters and patterns to be applied to the safeguarding thread. After a thread is embedded in an antifalsification paper this coating is invisible in incident light since the light reflected by the metal surface is diffusely scattered again in the paper. The recesses in the opaque layer are thus only recognizable as light surfaces when viewed in transmitted light. The back of the plastics film bears an electrically conductive layer 5 that is preferably transparent, but at least partly transparent. Transparent, electrically conductive layers are e.g. indium-tin oxide layers that are applied to the film material by the sputtering technique. The vacuum coating of plastics films with such materials is known (Kunststoffe 78 (1988) 9, G. Biekehör, Hanau "Vakuumbeschichten von Kunststoff-Folien," pp. 763–765). In many cases, however, a "thin" aluminizing suffices, which is cheaper and simpler in terms of process technology.

Aluminizing in an amount of approx. 20 mg/m$^2$ or less is characterized by sufficiently high transparency for most cases of application.

FIG. 2 shows a safeguarding thread 11 having writing consisting of reflective metallic characters 14, as known for example from EP-A 0 279 880. Since the single characters are not interconnected the thread is not electrically conductive along its entire length if it only contains these characters. According to the invention, this thread is supplemented by an electrically conductive layer 15 that extends across the entire thread surface but is at least partly transparent, so as not to impair the visibility of the writing. A transmission factor of approx. 50% is generally sufficient to allow the writing to be clearly detected without the use of aids even when the thread is embedded in paper. If higher demands are to be met, one can also apply fully transparent electrically conductive layers, such as the above-mentioned sputtered indium-tin oxide layer with e.g. 200 ohms per square surface. In the safeguarding thread shown in FIG. 2 characters 14 constitute one conductive layer, and layer 15 the other. Layer 14 thus corresponds to a layer with many selectively introduced interruptions. To improve the capacitive measurability the characters should cover as large an area as possible. If the individual characters are connected with each other one will likewise have an uninterrupted conductivity, as in the example shown in FIG. 1.

Instead of working the characters into a metal coating one can also print plastics carrier 22 accordingly for safeguarding thread 21 (FIG. 3). Print 24 can contain characters and/or colored patterns. Characters are preferably applied using an opaque ink so that they are well recognizable as dark areas in transmitted light. For color patterns, on the other hand, one preferably uses translucent or transparent colors so that these patterns are poorly visible in incident light and are recognizable as colored surfaces only in transmitted light. To give this thread the property of electric conductivity one provides it with transparent or translucent electrically conductive layers on both sides. If the print for this thread is not to compete with the outer print of the security document when the security document is viewed in incident light, one preferably uses partly reflective aluminizing, e.g. of approx. 20 mg/m$^2$ or 800 ohms per square surface, for the electrically conductive layers. Since a surface conductivity of 10,000 ohms per square surface suffices for machine testing, the aluminum layer can also be made substantially thinner if necessary.

In a special embodiment (FIG. 4), safeguarding thread 31 is composed of two carrier films 32 which enclose a printed pattern and/or electrically conductive coatings 35*a*, 35*b*. This protects the thin and generally sensitive layers (ITO layer, aluminum layer, etc.) against abrasion. The two films are interconnected by a nonconductive adhesive layer 36. A particular advantage of this structure is its symmetry. Such a safeguarding thread, that is unwound from a roll during paper production and guided to the mold at a predetermined place in the pulp, is less likely to form "festoons" or twist after it is unwound from the roll than asymmetrically constructed threads. This avoids the rejects occurring with threads of asymmetrical structure due to a lack of flatness of the thread in the paper layer.

Since the sensitive layers are moved to the inner areas of the safeguarding thread one can now use materials that could virtually not be used in the prior art due to the exposed position and the lack of environmental stability.

We claim:

1. A security document having a security element in the form of a transparent thread or strip embedded therein bearing marks in the form of characters, printed patterns and the like that are largely concealed when viewed in incident light but are optically detectable visually or by machine in transmitted light, said transparent thread or strip including at least one electrically conductive layer providing electrical conductivity for machine testability, the improvement wherein the electrically conductive layer is made of a material that is at least partially transparent and is disposed in the optical viewing path for the marks when the marks are viewed in transmitted light.

2. The security document according to claim 1, including an additional conductive layer comprising an opaque metal material, said opaque metal material arranged to define said marks.

3. The security document according to claim 1, wherein in addition to the at least partially transparent conductive layer, at least one further conductive layer is provided and said electrically conductive layers are separated galvanically by an insulating layer.

4. The security document according to claim 3, wherein the at least partially transparent conductive layer comprises a coating applied by sputtering.

5. The security document according to claim 4, wherein the at least partially transparent conductive layer comprises an indium-tin oxide layer.

6. The security document according to claim 3, wherein the at least partially transparent conductive layer comprises a vacuum evacuated metal layer.

7. The security document according to claim 6, wherein said vacuum evaporated metal layer comprises aluminum.

8. The security document according to claim 7, wherein the aluminum has an equivalent thickness of 20 mg/m$^2$.

9. The security document according to claim 1, wherein the at least partially transparent conductive layer comprises a screen.

10. The security document according to claim 3, wherein the at least partially transparent conductive layer comprises a screen.

11. The security document according to claim 1, wherein said marks are applied by printing techniques.

12. The security document according to claim 11, wherein the at least partially transparent conductive layer extends over each of said marks.

13. The security document according to claim 1, including an additional electrically conductive layer made of a material that is at least partially transparent and which is also disposed in the optical viewing path for the marks when they are viewed in transmitted light.

14. The security document according to claim 13, wherein the marks are applied by printing techniques, and wherein the at least partially transparent conductive layers extend over the security element on opposite sides of each of said marks.

15. The security document according to claim 14, wherein said at least partially transparent conductive layers are separated galvanically by an insulating layer.

16. The security document according to claim 15, wherein the insulating layer is made of aluminum oxide.

17. A security document having a security element in the form of a transparent thread or strip embedded therein bearing marks in the form of characters, printed patterns and the like that are largely concealed when viewed in incident light but are optically detectable visually or by machine in transmitted light, said transparent thread or strip comprising a pair of carrier films each having an electrically conductive layer secured thereto, one of the conductive layers being formed of a material that is at least partially transparent and which is disposed in the optical viewing path for the marks when the marks are viewed in transmitted light and the other conductive layer being arranged to define said marks for optical detection in transmitted light; said carrier films being adhered to each other by a nonconductive adhesive layer.

18. The security document according to claim 17, wherein said electrically conductive layers are disposed between said carrier films.

19. The security document according to claim 2, wherein one of said conductive layer defining said marks comprises an opaque metal layer defining said marks as recesses within said opaque metal layer.

20. A security document having a security element in the form of a transparent thread or strip embedded therein bearing marks in the form of characters, printed patterns and the like that are largely concealed when viewed in incident light but are optically detectable visually or by machine in tranmitted light, said transparent thread or strip comprising a pair of carrier films each including an electrically conductive layer formed of a material that is at least partially transparent and which is disposed in the optical viewing path for the marks when the marks are viewed in transmitted light; said carrier films being adhered to each other by a nonconductive adhesive layer.

21. The security document according to claim 20, wherein said electrically conductive layers are disposed between said carrier films.

22. A method for testing security documents containing at least one security element in the form of a transparent thread or strip embedded in said security document, said security element bearing marks in the forms of characters, printed patterns and the like that are substantially concealed when viewed in incident light but are optically detectable visually or by machine in transmitted light, and wherein said security elements include an electrically conductive layer capable of being detected electrically by machine, including the steps of:

(a) electrically detecting the presence and location of the security element in the security document; and
(b) after locating the security element in accordance with step (a), viewing the security element optically by viewing same in incident light.

23. A method for testing security documents containing at least one security element in the form of a transparent thread or strip embedded in said security document, said security element bearing marks in the form of characters, printed patterns and the like that are substantially concealed when viewed in incident light but are optically detectable visually or by machine in transmitted light, and wherein said security elements include an electrically conductive layer capable of being detected electrically by machine, including the steps of:

(a) electrically detecting the presence and location of the security element in the security document; and
(b) after locating the security element in accordance with step (a), viewing the security element optically by viewing same in transmitted light.

24. A method for testing security documents containing at least one security element in the form of a transparent thread or strip embedded in said security document, said security element bearing marks in the form of characters, printed patterns and the like that are substantially concealed when viewed in incident light but are optically detectable visually or by machine in transmitted light, and wherein said security elements include an electrically conductive layer capable of being detected electrically by machine, including the steps of:

(a) electrically detecting the presence and location of the security element in the security document using galvanic conductivity of the security element; and
(b) after locating the security element in accordance with step (a), viewing the security element optically by viewing same in incident light.

25. A method for testing security documents containing at least one security element in the form of a transparent thread or strip embedded in said security document, said security element bearing marks in the form of characters, printed patterns and the like that are substantially concealed when viewed in incident light but are optically detectable visually or by machine in transmitted light, and wherein said security elements include an electrically conductive layer capable of being detected electrically by machine, including the steps of:

(a) electrically detecting the presence and location of the security element in the security document using galvanic conductivity of the security element; and
(b) after locating the security element in accordance with step (a), viewing the security element optically by viewing same in transmitted light.

26. The process according to claim 22, wherein said electrical detection of the presence and location of the security element is carried out by a procedure other than utilization of galvanic conductivity of the security element.

27. The process according to claim 23, wherein said electrical detection of the presence and location of the security element is carried out by a procedure other than utilization of galvanic conductivity of the security element.

* * * * *